US009527095B2

(12) United States Patent
Kim

(10) Patent No.: US 9,527,095 B2
(45) Date of Patent: Dec. 27, 2016

(54) PUMPING NOZZLE INCLUDING SUCTION TUBE HAVING MULTIPLE OPENINGS, AND PUMP TYPE CONTAINER USING THE SAME

(71) Applicant: Solomon L. Kim, Palo Alto, CA (US)

(72) Inventor: Solomon L. Kim, Palo Alto, CA (US)

( * ) Notice: Subject to any disclaimer, the term of this patent is extended or adjusted under 35 U.S.C. 154(b) by 77 days.

(21) Appl. No.: 14/294,622

(22) Filed: Jun. 3, 2014

(65) Prior Publication Data

US 2015/0343471 A1 Dec. 3, 2015

(51) Int. Cl.
*B67D 7/78* (2010.01)
*B05B 11/00* (2006.01)
*B05B 15/00* (2006.01)

(52) U.S. Cl.
CPC ..... *B05B 11/3001* (2013.01); *B05B 11/0089* (2013.01); *B05B 15/005* (2013.01)

(58) Field of Classification Search
CPC ... B05B 11/3001; B05B 15/005; B65D 83/32; B65D 2231/004; B65D 1/323; B67D 1/0802; B67D 2001/0825
USPC ..... 222/464.2, 464.1, 189.1, 382
See application file for complete search history.

(56) References Cited

U.S. PATENT DOCUMENTS 349,651 A * 9/1886 Jacobs ..... B05B 9/0822 222/398
2,048,665 A * 7/1936 Dolan ..... B67D 1/0857 222/400.7
3,129,855 A * 4/1964 Malakoff ..... B65D 83/32 222/394
3,223,295 A * 12/1965 Falerni ..... G01F 11/265 222/438
3,240,399 A * 3/1966 Frandeen ..... B05B 11/047 222/211
3,245,582 A * 4/1966 Roth ..... B65D 83/62 222/386.5
3,260,421 A * 7/1966 Rabussier ..... B65D 83/14 222/402.18
3,788,521 A * 1/1974 Laauwe ..... B65D 83/62 222/94
4,159,790 A * 7/1979 Bailey ..... B05B 15/005 222/211
4,356,941 A * 11/1982 McRoskey ..... B05B 11/0059 222/211
5,143,288 A * 9/1992 Kohler ..... B65D 83/32 222/402.18
5,186,361 A * 2/1993 Williams ..... B65D 83/32 222/105
6,505,986 B1 * 1/2003 Oder ..... A45D 19/02 222/211
8,800,815 B1 * 8/2014 Butler ..... A47K 5/1208 141/114

(Continued)

*Primary Examiner* — J. Casimer Jacyna
*Assistant Examiner* — Benjamin R Shaw
(74) *Attorney, Agent, or Firm* — Kile Park Reed & Houtteman PLLC

(57) ABSTRACT

There are provided a pumping nozzle including a suction tube with multiple openings, and a pump type container including the pumping nozzle. The pumping nozzle includes: a pump disposed on an upper side of a container main body; a nozzle head configured to discharge a liquid contained in the container main body; and a suction tube communicating with the nozzle head and connected to the pump, wherein the suction tube includes a main opening formed in an end thereof and at least one sub-opening formed in a side thereof.

3 Claims, 2 Drawing Sheets

(56) References Cited

U.S. PATENT DOCUMENTS

| | | | | |
|---|---|---|---|---|
| 2005/0236433 | A1* | 10/2005 | Weck | B05B 11/0037 222/382 |
| 2005/0279773 | A1* | 12/2005 | Byrd | B05B 15/005 222/382 |
| 2007/0119875 | A1* | 5/2007 | Ehret | B67D 1/045 222/386.5 |
| 2008/0314932 | A1* | 12/2008 | Stone | F04B 33/00 222/209 |
| 2009/0071983 | A1* | 3/2009 | Pritchard | B05B 11/0043 222/211 |
| 2010/0155430 | A1* | 6/2010 | Schwandt | B05B 11/0059 222/383.3 |
| 2011/0233234 | A1* | 9/2011 | Drygala | B05B 11/0037 222/383.1 |
| 2012/0234862 | A1* | 9/2012 | Kharbanda | B05B 11/0037 222/173 |
| 2014/0151407 | A1* | 6/2014 | Zafrir | B05B 15/005 222/382 |

* cited by examiner

PUMPING NOZZLE INCLUDING SUCTION TUBE HAVING MULTIPLE OPENINGS, AND PUMP TYPE CONTAINER USING THE SAME

BACKGROUND

The present disclosure relates to a pumping nozzle including a suction tube having multiple openings, and a pump type container using the pumping nozzle. More particularly, the present disclosure relates to a pumping nozzle which is capable of effectively discharging fluid when a low level of content remains in a container main body, and a pump type container using the designed pumping nozzle.

In general, liquid or gel products such as liquid cosmetics (e.g., lotions or skin lotions), washing-up liquids, shampoos, rinses, and shower gels are filled in containers and are then sold.

Such containers containing various liquids may include a convenient discharge mechanism including a nozzle and a pump to discharge a certain amount of liquid each time the pump is pushed. The nozzle may be connected to a suction tube disposed on a container for suctioning a liquid. Such a pump type container discharges a certain amount of liquid each time a user pushes a pump of the pump type container, and thus may be conveniently used.

FIG. 1 illustrates an exemplary pump type container known in the related art. The pump type container includes a pump 20 and a nozzle head 10 disposed on an upper part of a container main body 30, and the nozzle head 10 is connected to a suction tube 100 to discharge the liquid contained in the container main body 30.

However, as shown in FIG. 1, if the level of a liquid filled in the container main body 30 is reduced to be close to a bottom surface of the container main body 30 as the liquid is continuously discharged, the remaining liquid may not be smoothly suctioned through the suction tube 100.

That is, since the liquid is suctioned through a main opening 200 formed in an end of the suction tube 100, suction may be possible only when the liquid is around the main opening 200. Thus, a portion of the liquid remaining on the bottom surface of the container main body 30 may not be sufficiently suctioned through the suction tube 100; if the liquid has high viscosity, this may be more problematic. This problem may not be solved even though the suction tube 100 is elongated close to the bottom surface of the container main body 30.

That is, it may be difficult for users to use a portion of liquid remaining on the bottom surface of such a container, and thus the remaining portion of liquid may be wasted, resulting in environmental pollution and economic loss.

Therefore, if a container including a nozzle capable of suctioning a low level of liquid remaining in a container main body is provided, the container may be usefully used in the related fields.

SUMMARY

An aspect of the present disclosure may provide a pumping nozzle capable of discharging a low level of a fluid remaining in a container main body.

An aspect of the present disclosure may also provide a pump type container capable of discharging fluid having a low level remaining in a container main body.

According to an aspect of the present disclosure, a pumping nozzle may include: a pump disposed on an upper side of a container main body; a nozzle head configured to discharge the liquid contained in the container main body; and a suction tube communicating with the nozzle head and connected to the pump, wherein the suction tube may include a main opening formed in an end thereof and at least one sub-opening formed in a side thereof.

The suction tube may include at least two sub-openings, and at least two sub-openings may be arranged in a line along the suction tube.

At least one sub-opening may be smaller than the main opening.

The suction tube may be formed of a soft material so as to be brought into contact with the bottom surface of the container main body.

The soft material may include at least one selected from the group consisting of polyethylene, polypropylene, polyvinylchloride (PVC), polyethylene terephthalate (PET), polystyrene (PS, HIPS), and acrylonitrile butadiene styrene (ABS).

According to another aspect of the present disclosure, a pump type container may include: a container main body; a pump disposed on the upper side of the container main body; a nozzle head configured to discharge a liquid contained in the container main body; and a suction tube communicating with the nozzle head and connected to the pump, wherein the suction tube may include a main opening formed in an end thereof and at least one sub-opening formed in a side thereof.

The suction tube may include at least two sub-openings, and at least two sub-openings may be arranged in a line along a length of the suction tube.

The suction tube may be positioned such that a portion of the suction tube located below the uppermost opening of at least two sub-openings may contact with the bottom surface of the container main body.

The suction tube may be positioned such that at least one sub-opening may face the bottom surface of the container main body.

At least one sub-opening may be smaller than the main opening.

The suction tube may be formed of a soft material so as to be brought into contact with the bottom surface of the container main body.

The soft material may include at least one selected from the group consisting of polyethylene, polypropylene, polyvinylchloride (PVC), polyethylene terephthalate (PET), polystyrene (PS, HIPS), and acrylonitrile butadiene styrene (ABS).

BRIEF DESCRIPTION OF DRAWINGS

The above and other aspects, features and other advantages of the present disclosure would be more clearly understood in the following detailed descriptions taken in conjunction with the accompanying drawings, in which.

DETAILED DESCRIPTION

Figure 1:
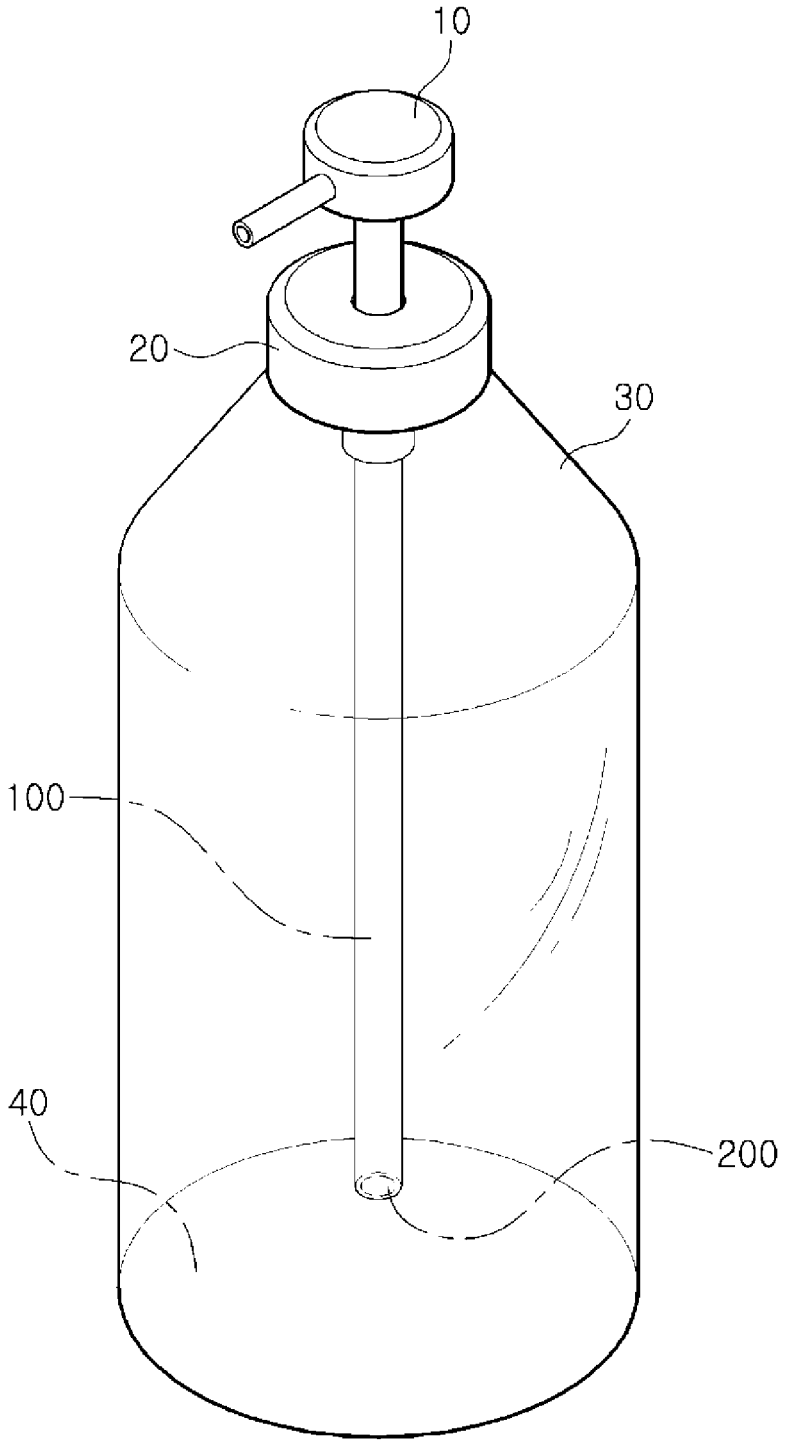
FIG. 1 illustrates an exemplary pump type container including a pumping nozzle known in the related art.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

The present disclosure relates to a pumping nozzle including a suction tube having multiple openings. In detail, the pumping nozzle includes: a pump disposed on the upper side of a container main body; a nozzle head configured to discharge a liquid contained in the container main body; and a suction tube communicating with the nozzle head and connected to the pump, wherein the suction tube includes a main opening formed in an end thereof and at least one sub-opening formed in a side thereof.

Figure 2:
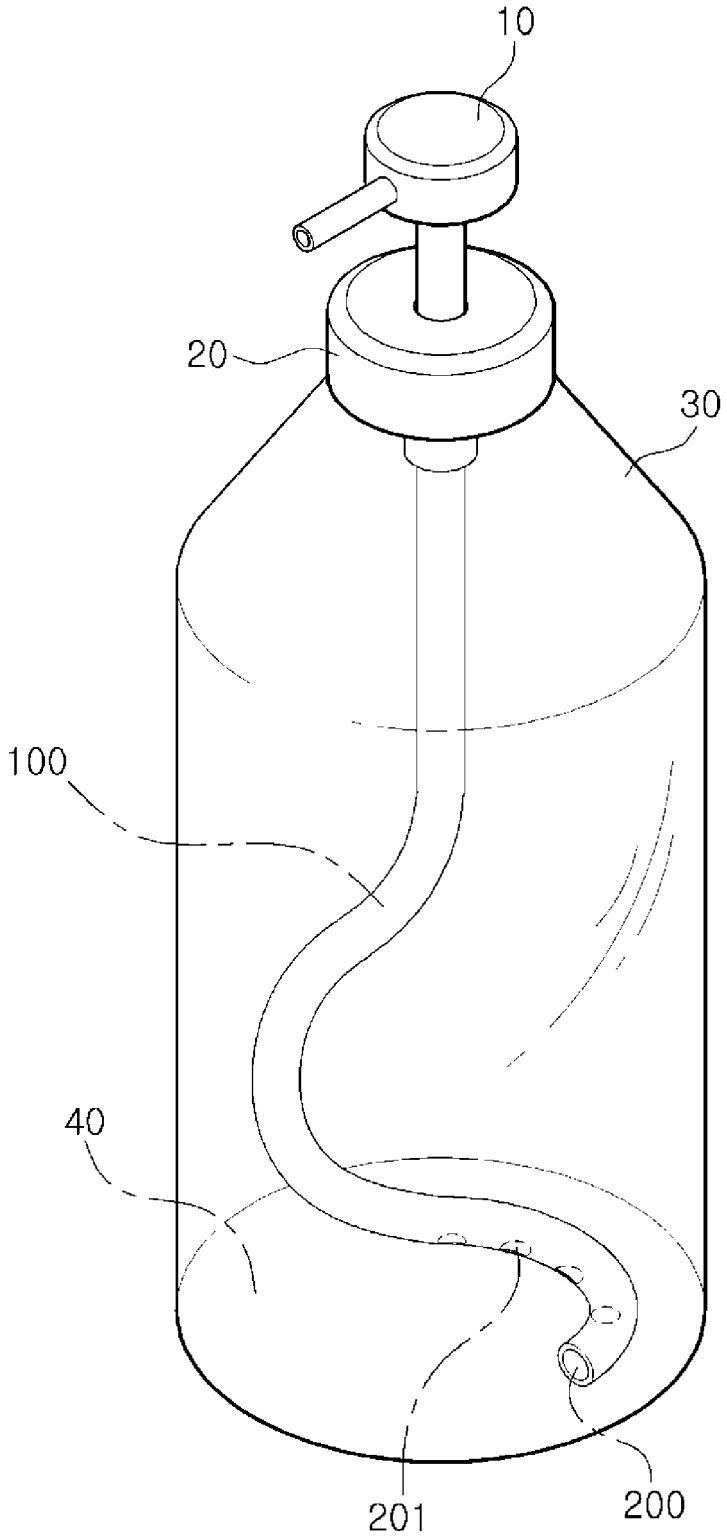
FIG. 2 illustrates an exemplary pump type container including a pumping nozzle according to an embodiment of the present disclosure.

An embodiment of the present disclosure will now be described in detail with reference to FIG. 2. Referring to FIG. 2, a pumping nozzle includes: a pump 20 configured to be disposed on the upper side of the container main body 30 in which various kinds of liquid may be contained; a nozzle head 10 configured to discharge a liquid from the container main body 30; and a suction tube 100 communicating with the nozzle head 10 and connected to the pump 20. Particularly, the suction tube 100 includes a main opening 200 formed in an end of the suction tube 100 and at least one sub-opening 201 formed in a side of the suction tube 100.

In the embodiment of the present disclosure, materials that can be used to form the container main body 30 are not limited thereto. The container main body 30 may be formed of a hard material to contain a liquid without being deformed by surrounding environments such as temperature and pressure. For example, the container main body 30 may be formed of a hard polymer resin, glass, or metal.

The pumping nozzle of the embodiment of the present disclosure may be used to discharge any liquid that has viscosity within a range suitable for being suctioned through the suction tube 100. Examples of the liquid may include liquid or fluid cosmetics, shampoos, rinses, gargles, detergents, and washing-up liquids.

The effect of the pumping nozzle of the embodiment of the present disclosure may be more significant when the pumping nozzle is used for a fluid remaining on the bottom surface of the container main body 30 due to a high degree of viscosity.

The pump 20 and the nozzle head 10 of the pumping nozzle of the embodiment of the present disclosure are not limited to particular structures. That is, the pump 20 and the nozzle head 10 may have any structures, as long as the pump 20 and the nozzle head 10 communicate with or are assembled with the suction tube 100 so that the pump 20 can suction and discharge a liquid through the suction tube 100 when a user pushes the nozzle head 10.

Particularly, in the embodiment of the present disclosure, the suction tube 100 of the pumping nozzle includes the main opening 200 formed in an end thereof and at least one sub-opening 201 additionally formed in a side thereof.

For example, the number of at least one sub-opening 201 may be 1 to 10. Preferably, the number of at least one sub-opening 201 may be 1 to 5. If the number of at least one sub-opening 201 is larger than the range, suction force may be lowered due to the excessive total open area.

At least one sub-opening 201 is formed on the side of the suction tube 100. If the number of at least one sub-opening 201 is two or more, the sub-openings 201 may be arranged in a line along the length of the suction tube 100. If a plurality of sub-openings 201 are arranged in a line along the length of the suction tube 100, when the pumping nozzle is connected to the container main body 30, all the sub-openings 201 may be positioned to face the bottom surface of the container main body 30 for effectively suctioning a fluid remaining on the bottom surface of the container main body 30.

The sizes of the sub-openings 201 may be smaller than the size of the main opening 200. If the sizes of the sub-openings 201 are greater than the main opening 200 and are excessively large, the durability of the suction tube 100 may be lowered, and suction force may be lowered due to an excessive total open area.

The suction tube 100 may be formed of a soft material so as to be brought into contact with the bottom surface of the container main body 30. The soft material for the suction tube 100 is not limited to a particular material. For example, the soft material may include at least one selected from the group consisting of polyethylene, polypropylene, polyvinylchloride (PVC), polyethylene terephthalate (PET), polystyrene (PS, HIPS), and acrylonitrile butadiene styrene (ABS).

In addition, another embodiment of the present disclosure provides a pump type container including the above-described pumping nozzle.

In detail, according to the other embodiment, the pump type container includes: a container main body; a pump disposed on the upper side of the container main body; a nozzle head configured to discharge a liquid contained in the container main body; and a suction tube communicating with the nozzle head and connected to the pump, wherein the suction tube includes a main opening formed in an end thereof and at least one sub-opening formed in a side thereof.

Techniques related to the pumping nozzle are the same as those described in the previous embodiment.

In the embodiment, when the pumping nozzle is coupled to the container main body, the suction tube may be positioned such that the sub-opening may make contact with the bottom surface of the container main body. If two or more sub-openings are formed in the suction tube, the sub-openings may be positioned so that a portion of the suction tube located below the uppermost sub-opening may make contact with the bottom surface of the container main body.

In this case, the sub-openings may be oriented to face the bottom surface of the container main body.

In this structure, after one of the sub-openings is used to suction a portion of fluid remaining around the sub-opening, the sub-opening may be brought into tight contact with the bottom surface of the container main body, and thus another of the sub-openings may be used to smoothly suction the other portion of the fluid.

As set forth above, according to the exemplary embodiments of the present disclosure, the suction tube including a plurality of openings is provided to the pump and the pumping nozzle connected to the pump, and the pumping nozzle may be attached to an upper side of a container main body to smoothly discharge a low level of a fluid remaining on the bottom surface of the container main body. Therefore, according to the embodiments of the present disclosure, various kinds of fluids remaining in containers may not be wasted, and thus environmental pollution and economical loss may be prevented.

While exemplary embodiments have been shown and described above, it will be apparent to those skilled in the art that modifications and variations could be made without departing from the spirit and scope of the present disclosure as defined by the appended claims.

What is claimed is:

1. A container consisting of:

a container main body;

a pump disposed on the upper side of the container main body;

a nozzle head configured to discharge a liquid contained in the container main body; and a suction tube communicating with the nozzle head and connected to the pump, wherein the suction tube comprises a main opening formed in an end thereof and at least two sub-openings formed in a side thereof arranged in only one line along a length of the suction tube, and wherein the suction tube is positioned such that the at least two sub-openings face a bottom surface of the container main body, and such that a portion of the suction tube located below an uppermost opening of the at least two sub-openings makes contact with a bottom surface of the container main body.

2. The container of claim 1, wherein the at least one sub-opening is smaller than the main opening.

3. The container of claim 1, wherein the suction tube is formed of at least one material selected from the group consisting of polyethylene, polypropylene, polyvinylchloride (PVC), polyethylene terephthalate (PET), polystyrene (PS, HIPS), and acrylonitrile butadiene styrene (ABS), so as to be brought into contact with a bottom surface of the container main body.

* * * * *